US005275211A

United States Patent [19]

Roth

[11] Patent Number: 5,275,211

[45] Date of Patent: Jan. 4, 1994

[54] ELECTROMAGNETICALLY ACTIVATED JACQUARD CONTROL ARRANGEMENT

[75] Inventor: Josef Roth, Seligenstadt, Fed. Rep. of Germany

[73] Assignee: Karl Mayer Textilmaschinenfabrik GmbH, Obertshausen, Fed. Rep. of Germany

[21] Appl. No.: 918,638

[22] Filed: Jul. 21, 1992

Related U.S. Application Data

[63] Continuation-in-part of Ser. No. 749,564, Aug. 26, 1991, abandoned.

[30] Foreign Application Priority Data

Sep. 7, 1990 [DE] Fed. Rep. of Germany ..... 4028390

[51] Int. Cl.[5] ..... D03C 3/20

[52] U.S. Cl. ..... 139/455

[58] Field of Search ..... 139/455, 59, 68

[56] References Cited

U.S. PATENT DOCUMENTS 4,702,286 10/1987 Palau et al. ..... 139/59
5,002,099 3/1991 Seiler ..... 139/455
5,029,618 7/1991 Kleiner ..... 139/455

FOREIGN PATENT DOCUMENTS 0108700 3/1983 European Pat. Off. .

OTHER PUBLICATIONS

Kettenwirk-praxis Feb. 1988, Obertshausen, pp. 11-12.

*Primary Examiner*—Andrew M. Falik
*Attorney, Agent, or Firm*—Omri M. Behr; Matthew J. McDonald

[57] ABSTRACT

An electromagnetically activated jacquard control arrangement comprising a plurality of control elements each combined with a lifter element (16) and each provided with an electromagnet (19) with an armature (21). There is further provided a lifter plate (7) which, in each working cycle, lifts the lifter element (16) out of a rest position into a working position and which thereafter is again lowered so that the lifter element, in dependence upon the activation condition of the electromagnet, remains in the working position or returns to the rest position. Every lifter element (16) comprises a hook (26) which operates together with a counterhook held in a predetermined elevation. Each armature (21) is rotatably mounted on an axis (24) and by its swinging movement, displaces the counterhook into or out of the path of the lifter element hook. The lifter plate (7) can lift the lifter element beyond the working position into a predetermined zone. Further lifter plate (7) carries a dog plate (29) which swings the armature against the appropriate electromagnets (19) when the lifter element is located in the aforesaid predetermined zone. This mode of construction requires relatively little magnetic force. Thus small magnets may be used.

25 Claims, 5 Drawing Sheets

ELECTROMAGNETICALLY ACTIVATED JACQUARD CONTROL ARRANGEMENT

RELATED APPLICATIONS

This application is a continuation-in-part of U.S. Ser. No. 07/749,564, filed on Aug. 26, 1991, now abandoned.

BACKGROUND OF THE INVENTION

The present invention is directed to an electromagnetically activated jacquard control arrangement having a plurality of control elements. Each control element is connected with a lifter element, each having an electromagnet with an armature and a lifter plate. The lifter plate, in each working cycle, moves the lifter element out of a rest position into a work position, wherein the armature is drawn to the electromagnet and thereafter lowered so that the lifter element, in dependence upon the activation condition of the electromagnet, remains in the working position or returns to the rest position.

In known jacquard control arrangements of this type (Kettenwirk Praxis #2/88 pages 11 and 12) the lifter elements are connected to the armature so that when the lifter element is moved into a working position, the armature must also be moved into contact with the appropriate electromagnet. In this reference stronger and larger electromagnets are required because the electromagnetic forces must be sufficient to hold the armature in the upper postion despite the downwardly acting forces on the harness cords.

In EP OS 108 700, the harness cords are mechanically held in the upper position by hook 25*a*. Nevertheless, strong electromagnets are required because it is not possible to avoid an air space between the armature 25 and the electromagnet 27 on the one hand because the armature is formed by a bendable leaf spring, and on the other hand because the angle surface 18*c* along which the hook 25*a* slides, gives rise to frictional forces.

The purpose of the present invention is to provide an electromagnetically activated, jacquard control arrangement of the type found in the prior art, but refined to enable operation with smaller electromagnets, thereby achieving a more compact construction.

SUMMARY OF THE INVENTION

In accordance with the illustrative embodiments demonstrating features and advantages of the present invention, there is provided an electromagnetically activated jacquard control arrangement for affecting threads in a machine. The control arrangement has a plurality of control elements for selectively controlling the threads. A plurality of lifter elements are each connected to a corresponding one of these control elements. Each of these lifter elements has a hooking element. A plurality of electromagnets are each associated with a corresponding one of the lifter elements. A plurality of armatures are swingably mounted in the machine and sized to be held by corresponding ones of the electromagnets when in proximity thereto. A lifter structure can reciprocate in the machine to lift the lifter elements from a rest position to a working position, where the armatures contact the electromagnets. The lifter structure can move the lifter elements beyond the working position into a predetermined zone. A dog member coupled to the lifter structure can swing the armatures against the electromagnets when the lifter elements are located in the predetermined zone. A plurality of hooking members shaped to engage corresponding ones of the hooking elements are mounted about a predetermined elevation and are arranged to be displaced by the armatures between positions in and out of the path of the hooking elements of the lifter element. The hooking members can, when in the path of the hooking elements, engage and hold the hooking elements, so that the lifter elements, in dependence upon the activation condition of the electromagnets, remain in the working position or return to the rest position when the lifter structure subsides.

Objectives of the present invention are achieved with the preferred embodiment. Specifically, each lifter element is provided with a hook which, in the working position, operates in conjunction with a counterhook placed at a predetermined elevation. Each armature is swingably mounted about an axis so the swinging action displaces the counterhook out of or into the path of the lifter element. The lifter plate of the lifter element moves out of the working position into a predetermined location and carries a dog plate arrangement which swings the armatures against the appropriate electromagnets when the lifter elements are located in the predetermined location.

In this construction the lifter element and the armature are separated from each other. The pretension acting on the lifter element over the harness cord is absorbed by the counterhook located at a predetermined height. It does not impact the armature. Thus, lower magnetic forces are required; the electromagnets can be made smaller. Thus, in a given space, there may be provided a larger number of side by side units. Furthermore, the armature has a defined position with respect to the electromagnet, since the armature can only perform a rather small swinging movement and is kept in position by the said axis. This also reduces the required magnetic forces. On the other hand, it has also been shown that small swinging movements are quite sufficient in order to obtain a secure separation between the hook and the counterhook. The dog plate ensures that despite the separation of the armature and the lifter element, a secure contact of all armatures to the appropriate electromagnets will ensue.

It is desirable that the dog plate operates on the armature through the interposition of a spring element. This enables small irregularities to be smoothed out.

Suitably, the dog plate is generally formed by a vertical beam extending next to the lifter element. This gives rise to a space-economical mode of construction and contributes to the rigidity of the lifter plate.

It is further advantageous that the electromagnet is so located above the lifter plate that the dog plate engages substantially at the middle of the armature and that the movement path of the hooks extends sidewards therefrom. In this construction, the ends of the armatures, that is to say a lever carried thereby, lie substantially perpendicular to the movement path of the hooks so that there is a space saving construction in the direction of the armature.

In a particularly simple mode of construction the armature is provided as one arm of a dog lever and the counterhook is provided at its other arm. The axis of rotation enables the hook to be held at a predetermined height when it works together of the hook of the lifter element. When the other arm of the dog lever extends downwardly and the hook is provided on the lifter element, the activation of the electromagnet enables the counterhook to free the lifter element. When the other arm of the dog lever is stretched upwardly and the hook is connected with the lifter element via a spring element, the activation of the electromagnet serves to hold the lifter element in the working position.

In a particularly simple mode of construction the carrying element is a dog lever and the armature is attached to one of its arms and the counterhook on the other of its arms. The axis of rotation thus serves to hold the counterhook at the predetermined height when it works together with the hook of the lifter element. When the other arm of the dog lever is extended downwardly and the hook is provided on the lifter element, the activation of the electromagnet serves to release the counterhook from the lifter element. When the other arm of the dog lever is extended Upwardly and the hook is connected with the lifter element by means of spring element, the activation of the electromagnets serves to hold the lifter element in the working position.

In another embodiment the counterhook is provided with a spring element, which is fixed at its upper end and is displaceable by the swinging movement of the carrier element. In this construction all of the forces operating on the lifter element are taken up by the attachment point of the spring element.

Thus, the armature can be attached to one arm of a dog lever forming the carrier element whose other arm forms a striker or stop.

It is further desirable to provide a release spring between the armature and one pole of the electroelement, so that the residual hysteresis forces do not lead to an adhesion of the armature to the magnet.

It is furthermore particularly desirable, that the armature is attached to a carrier element and is swingable about an axis located between the poles of the electromagnets. This gives rise to an automatic provision of the armature to the pole surfaces.

BRIEF DESCRIPTION OF THE DRAWINGS

The invention may be illustrated in the preferred embodiment illustrated as follows.

DETAILED DESCRIPTION OF THE DRAWINGS

Figure 1:
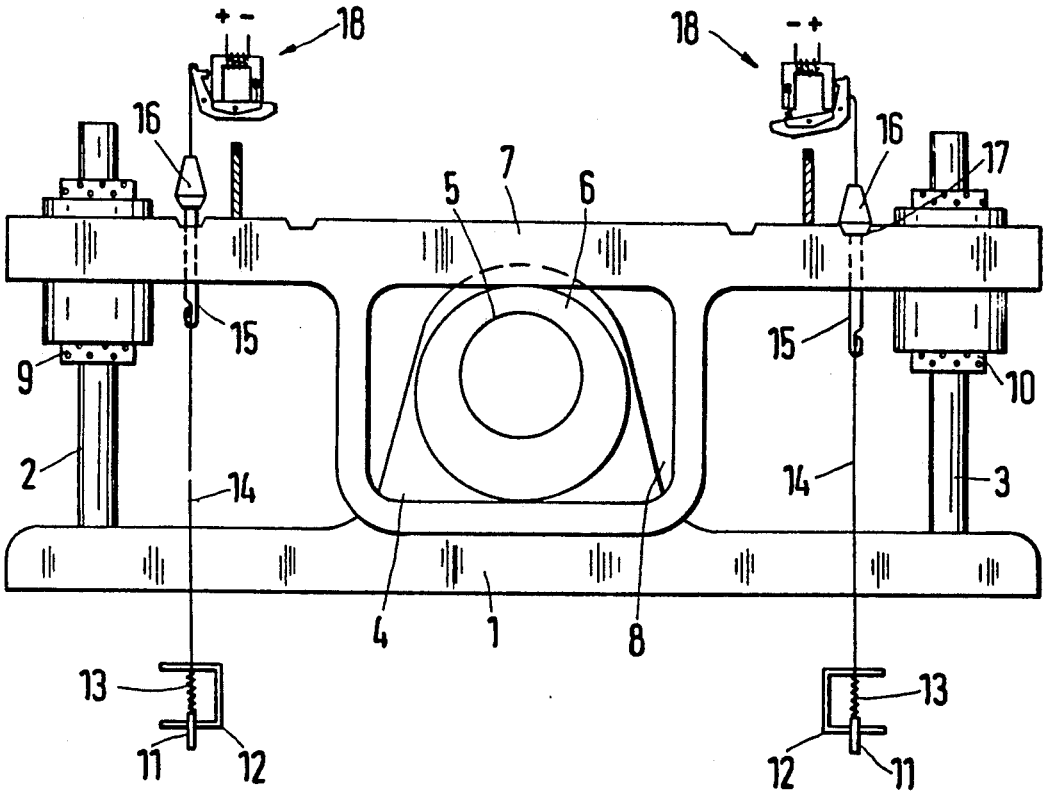
FIG. 1 is a schematic, side elevational view of a jacquard arrangement in accordance with the present invention.

FIG. 1 illustrates a frame 1 having vertical guide rods 2 and 3, as well as a bearing 4 for shaft 5 carrying an eccentric cam 6. A lifter plate 7 (also identified as a lifter structure) has a window 8 which circumscribes the cam 6. Lifter plate 71 also has roller bearings 9 and 10 by means of which the lifter plate 7 is led on the guide bars 2 and 3. When the cam 6 rotates, lifter plate 7 moves in a vertical direction.

Control elements 11 in the form of displacement pegs or displacement sinkers which displace the jacquard guides (not shown) by one needle space are mounted in bars 12 and biased by springs 13. Control elements 11 are connected with tension hooks 15 via harness cords 14, which are attached to the lifter elements 16 and which penetrate lifter plate 7. The control elements 11 and their appropriate lifter element 16 can occupy a rest position in which the lifter element rests in a seating 17 in the lifter plate 7 (right side of FIG. 1), or in a working position, in which the control element 11 and the appropriate lifter element 16 are elevated (left side in FIG. 1). These positions may be achieved through the assistance of the electromagnetic arrangements 18, as may be seen by reference to the drawings as described hereinafter. Four parallel grooves may serve as the seating positions in which, for example, 256 lifter elements may be provided.

Figure 2:
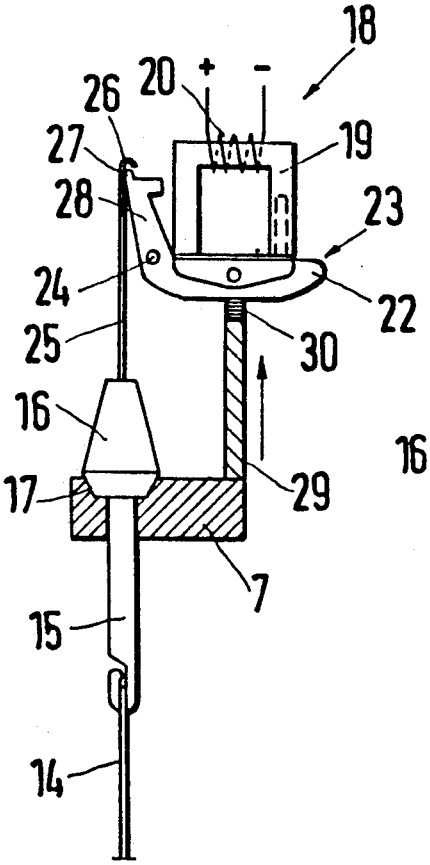
FIGS. 2 through 4 are detailed, schematic, side elevational views of the working area in different conditions.
Figure 3:
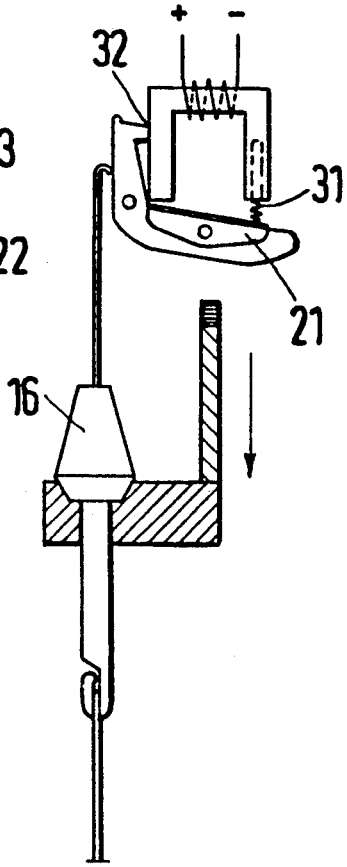
Figure 4:
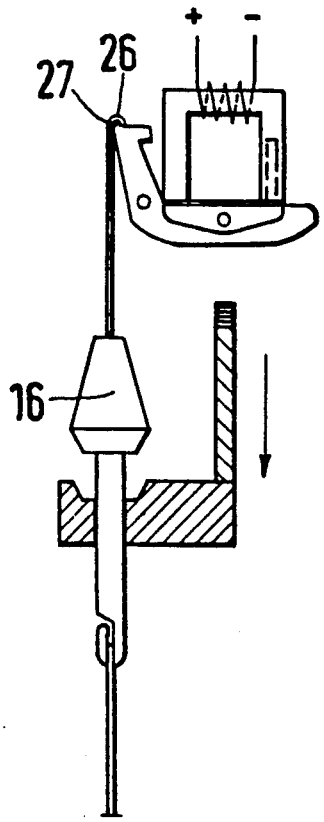

FIGS. 2 through 4 illustrate an embodiment comprising a magnetic arrangement 18 having an electromagnet 19 provided with a U-shaped core and a winding 20 as well as, an armature 21. Armature 21 is pivotally attached to arm 22 on dog lever 23, which is swingable about an axis 24. The lifter element 16 carries flexible element 25 having an upper hook 26 (also identified as a hooking element) which operates together with counterhook 27 (also identified as a hooking member) on the other arm 28 of dog lever 23. Additionally, a dog plate 29 (also identified as a dog member) in the form of a beam extends vertically next to the lifter element 16 atop plate 7. This beam, through the interposition of a resilient element 30, operates on armature 21 and arm 22 substantially centrally with respect to the electromagnet 19. There is further provided, a release spring 31 in one of the pole surfaces of the electromagnet 19 in order to ensure that the armature is pushed away when the electromagnet 19 is not activated. In this case, the nose 32 forms a striker or stop which determines the extreme position of the swinging movement.

There are several possibilities for the formation of the resilient spring element 30. For example, there may be provided a rail of elastic material. It is also possible to provide to each individual armature its particular individual spring, for example, a compression spring with blocks.

FIG. 2 shows the lifter plate 7 in its uppermost position, extend beyond a rest position into a predetermined zone. FIGS. 3 and 4 show lifter plate 7 in its lowest position. In FIG. 3 the lifter element 16 is shown in the rest position and in FIG. 4 in the working position. If for example, electromagnet 19 in the position of FIG. 2 is not activated, on the downstroke of the lifter plate 7, the counterhook 27 is tipped into the position shown in FIG. 3 so that the lifter element 16 returns to the starting position together with lifter plate 7. On the other hand, if the electromagnet 19 is activated, counterhook 27 remains in the position shown in FIG. 2, so that the hook 26 can work with it and the lifter element 16 is held in the work position of FIG. 4.

Figure 5:
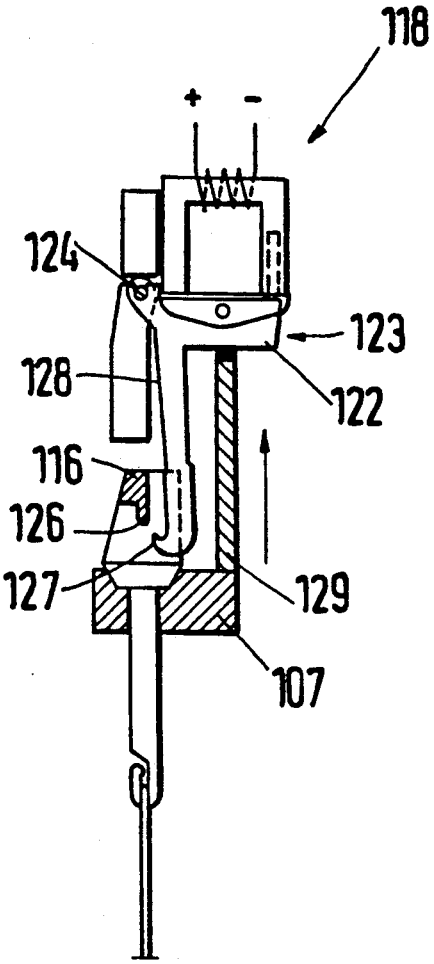
FIGS. 5 through 7 are detailed, schematic, side elevational views of different embodiments showing the working position in three different settings from those of FIGS. 2–4.
Figure 6:
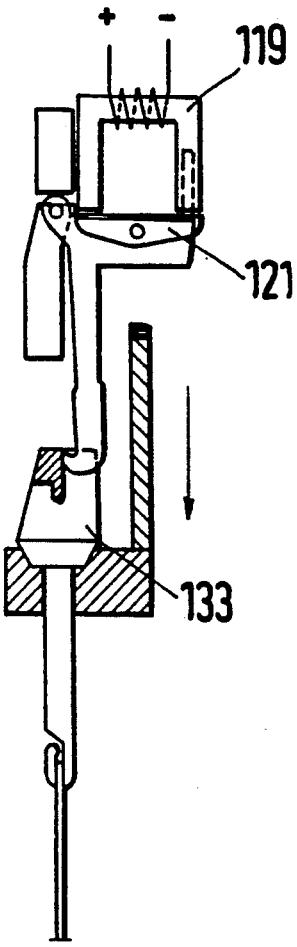
Figure 7:
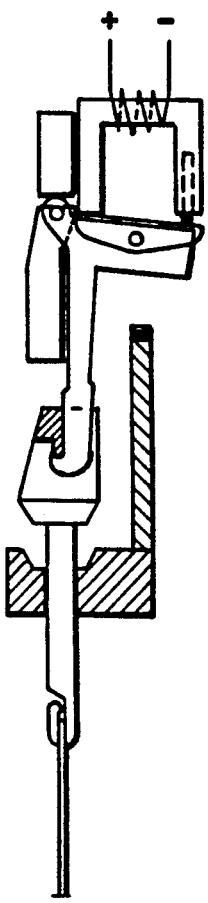

Another embodiment is shown in FIGS. 5 through 7, wherein the corresponding parts are identified by the prefix 1. Two armed dog lever 123 carries armature 121 on its first arm 122. The principal difference between FIGS. 2 through 4 is that the other arm 128 of dog lever 123 is directed downwardly, so that counterhook 127 can positively engage hook 126 on lifter element 116. In order to facilitate the entry of the counterhook 127 into lifter element 116, it is provided with a longitudinal slit 133.

This leads to a functional difference in that the lifter element 116, upon activation of electromagnet 119, returns to the rest position (FIG. 6) and when the electromagnet is not activated is held in the working position (FIG. 7).

Figure 8:
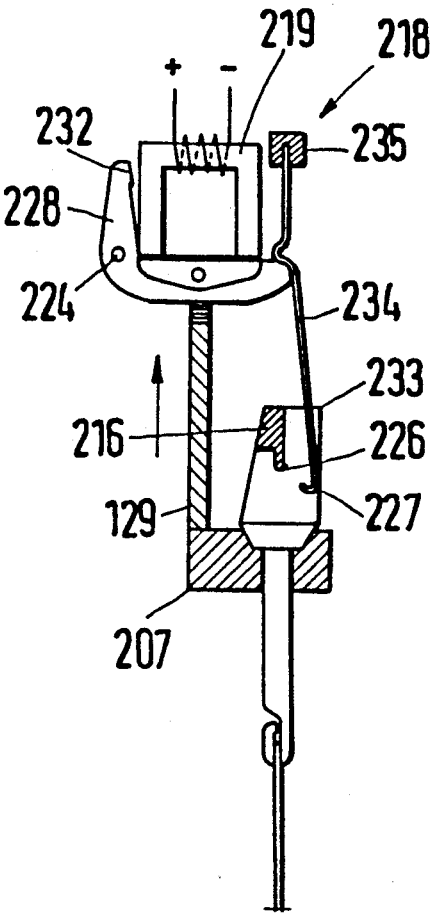
FIGS. 8 through 10 are detailed, schematic, side elevational views of yet further alternatives of the working positions in three different settings from those of FIGS. 2–7.
Figure 9:
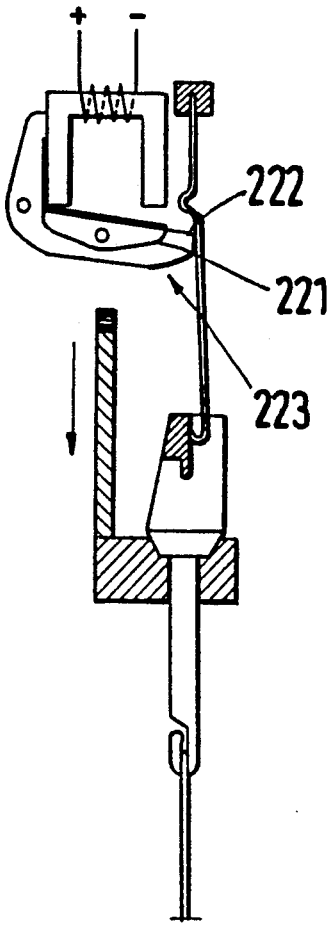
Figure 10:
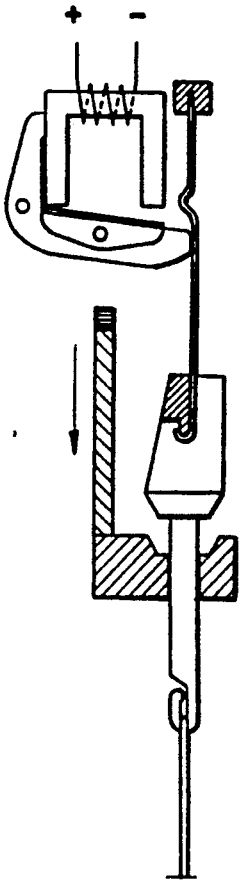

In the further working example of FIGS. 8 through 10, corresponding items carry the prefix 2. The counterhook 227 sits at the end of flexible element 234, which is affixed at an insertion point 235. This spring element 234 presses diagonally outwardly on the armature 221; in particular, its carrying arm 222, when the electromagnet 219 is activated (see FIG. 8). However when the lifter plate 207 is dropped, lifter element 216 follows into the rest position (FIG. 9). However, if the electromagnet is not activated (FIG. 10) the counterhook 227 holds the lifter element 216 on hook 226 in the working position.

Figure 13:
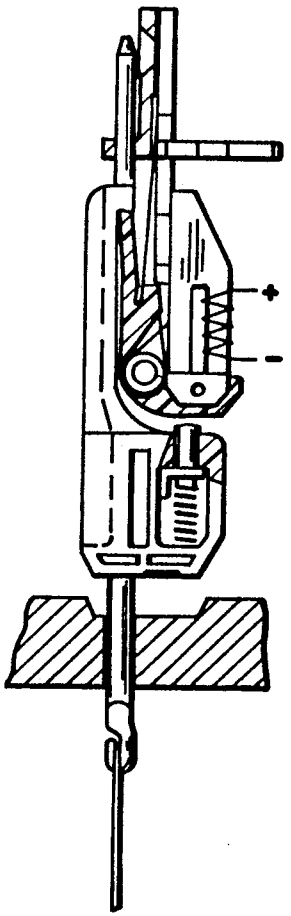
FIGS. 11 through 13 show alternate embodiments of FIGS. 2–4.
Figure 12:
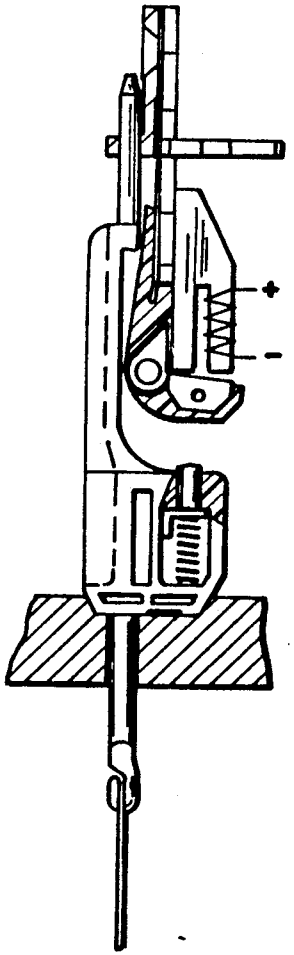
Figure 11:
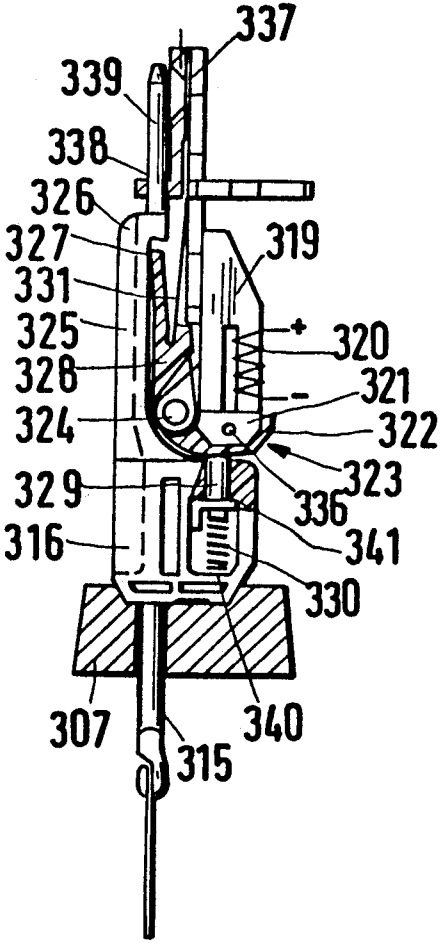

In the examples illustrated in FIGS. 11 through 13, the corresponding items are raised by the number 300 with respect to the items numbers in FIGS. 2-4. The electromagnet 19 sits in a common frame 337 in which channels 338 are provided for pins 339 which are formed on the upper side of hooks 326. These hooks 326 are rigidly connected with the lifter element 316 via a rigid connector 325. Since the pulling hooks 315 are also led into the lifter plate 307 the path of the hook 325 is clearly set in both the upward and downward movement.

The dog lever 323 is supported by means of axis 324 on a crosspiece of the core of the electromagnet 319. On its first arm 322 it carries the armature 321 on the first arm 322 which is swingable about an axis 326. The second vertical arm 328 carries the counterhook 327 which lies on the pulled in armature 321 in the path of hook 326 (FIG. 13) and where the armature is released lies outside the path (FIG. 12).

In this construction the dogplate arrangement is formed through the dogplate 329 in which the lifter element 316 is led vertically and supported via a spring 330 on the support surface 340 of the setting body. The vertical movement is limited by the stop 341.

I claim:

1. An electromagnetically activated jacquard control arrangement for affecting threads in a machine comprising:

a plurality of control elements for selectively controlling said threads;

a plurality of lifter elements each connected to a corresponding one of said control elements, each of said lifter elements having a principal axis and a hooking element;

a plurality of electromagnets each having two poles and each associated with a corresponding one of said lifter elements;

a plurality of dog levers swingably mounted in said machine and having a first arm extending transversely to the principal axis of the lifter elements and a second arm;

a plurality of armatures, each mounted on said first arm of said dog levers and sized to be held by corresponding ones of said electromagnets when in contact therewith;

a lifter structure for reciprocating in said machine to lift the lifter elements from a rest position to a working position where the armatures are in proximity to the electromagnets, the lifter structure being operable to move the lifter elements beyond the working position into a predetermined zone;

a dog member means for swinging the armatures against the electromagnets when the lifter elements are located in said predetermined zone;

a plurality of hooking members shaped to engage corresponding . ones of said hooking elements, said hooking members being mounted about a predetermined elevation and arranged to be displaced by the second arm of said dog levers between positions in and out of the path of the hooking elements of the lifter elements, said hooking members being operable when in the path of said hooking elements to engage and hold said hooking elements, said hooking members being operable when out of the path of said hooking elements to avoid said hooking elements to descend past said hooking members, so that said lifter elements, in dependence upon the activation condition of the electromagnets and upon the positions of the hooking elements, remain in the working position or return to the rest position when said lifter structure subsides.

2. Jacquard arrangement according to claim 1, wherein the dog member means is coupled to the lifter structure.

3. A jacquard arrangement in accordance with claim 2 wherein the electromagnets are located above the lifter structure and wherein the dog member means engages the dog levers about the center of the armatures and wherein the hooking elements move in a path alongside the dog member.

4. A jacquard arrangement in accordance with claim 3 wherein:

the second arm of the dog levers supports a corresponding one of said hooking members.

5. A jacquard arrangement in accordance with claim 3 further comprising:

a return spring located between one pole of each of the electromagnets and each of said corresponding armatures.

6. A jacquard arrangement in accordance with claim 4 wherein the second arm of the dog lever extends downwardly and the hooking elements are affixed to the lifter elements.

7. A jacquard arrangement in accordance with claim 6 further comprising:

a plurality of dog levers pivotally mounted in said machine, said armatures being pivotally attached to corresponding ones of said dog levers at a pivot point located between the two poles of the electromagnets.

8. A jacquard arrangement in accordance with claim 2 further comprising:

a plurality of return springs located between one pole of the electromagnets and said armatures.

9. A jacquard arrangement in accordance with claim 2 further comprising:

a plurality of dog levers pivotally mounted in said machine, said armatures being pivotally attached to corresponding ones of said dog levers at a pivot point located between the two poles of the electromagnets.

10. A jacquard arrangement according to claim 1, wherein the dog member means comprises a plurality of dog members each coupled to a lifter element.

11. A jacquard arrangement according to claim 10, wherein each dog member is guided for a limited vertical movement in the corresponding lifter element and resilient elements are located between each dog member and a support on the corresponding lifter element.

12. A jacquard arrangement in accordance with claim 10 wherein the dog member means substantially comprises a vertically extending beam adjacent to said lifter elements.

13. A jacquard arrangement in accordance with claim 12 further comprising:

a return spring located between one pole of each of the electromagnets and each of said corresponding armatures.

14. A jacquard arrangement in accordance with claim 12 further comprising:

a plurality of dog levers pivotally mounted in said machine, said armatures being pivotally attached to corresponding ones of said dog levers at a pivot point located between the two poles of the electromagnets.

15. A jacquard arrangement according to claim 1, wherein the dog member means has a resilient element located between it and the armature.

16. A jacquard arrangement in accordance with claim 1 wherein the dog member means comprises a substantially upright beam adjacent to said lifter elements.

17. A jacquard arrangement in accordance with claim 1 wherein the electromagnets are located above the lifter structure and wherein the dog member means engages the dog levers about the center of the armatures and wherein the hooking elements move in a path alongside the dog member.

18. A jacquard arrangement in accordance with claim 1 wherein:

the second arm of the dog levers supports a corresponding one of said hooking members.

19. A jacquard arrangement in accordance with claim 18 wherein:

each of said plurality of dog levers has an upwardly extending second arm; and said plurality of flexible elements connect between said lifter elements and said hooking elements.

20. A jacquard arrangement according to claim 18, wherein each of said dog levers has an upwardly extending second arm; and each of said hooking elements is rigidly connected to the corresponding lifting element.

21. A jacquard arrangement according to claim 20, wherein each hooking element is provided at its upper side with a pin which is guided in said machine.

22. A jacquard arrangement in accordance with claim 1 wherein;

the second arm of said dog levers is constructed as a stop.

23. A jacquard arrangement according to claim 1 further comprising a plurality of return leaf springs located between the second arm of the dog levers and a frame bearing the electromagnets.

24. A jacquard arrangement in accordance with claim 1 further comprising:

a plurality of return springs located between one pole of the electromagnets and said armatures.

25. A jacquard arrangement in accordance with claim 1 further comprising:

a plurality of dog levers pivotally mounted in said machine, said armatures being pivotally attached to corresponding ones of said dog levers at a pivot point located between the two poles of the electromagnets.

* * * * *